US006163032A

United States Patent [19]

Rockwood

[11] Patent Number: 6,163,032

[45] Date of Patent: Dec. 19, 2000

[54] TAPERED OR TILTED ELECTRODES TO ALLOW THE SUPERPOSITION OF INDEPENDENTLY CONTROLLABLE DC FIELD GRADIENTS TO RF FIELDS

[75] Inventor: Alan L. Rockwood, Provo, Utah

[73] Assignee: Leco Corporation, St. Joseph, Mich.

[21] Appl. No.: 08/814,898

[22] Filed: Mar. 12, 1997

[51] Int. Cl.[7] ..... H01J 49/00

[52] U.S. Cl. ..... 250/396 R; 250/292

[58] Field of Search ..... 250/396 R, 292, 250/290, 293

[56] References Cited

U.S. PATENT DOCUMENTS 5,847,386 12/1998 Thomson et al. ..... 250/292

FOREIGN PATENT DOCUMENTS 9707530 2/1997 Canada .

*Primary Examiner*—Kiet T. Nguyen

*Attorney, Agent, or Firm*—Morriss, Bateman, O'Bryant & Compagni

[57] ABSTRACT

The present invention is embodied in a method and apparatus for transporting ions via a path generated by RF electrodes having a controllable DC field gradient generated thereon which does not suffer from mass discrimination. In a preferred embodiment, the number of electrodes are doubled to thereby use symmetry to cancel an undesirable DC quadrapole field. By eliminating the DC quadrapole field, the passband of the DC field gradient is increased, allowing for ions of higher mass to be transported. The electrodes are either tilted or tapered to thereby generate the desirable DC field gradient. Tilting and/or tapering the electrodes advantageously modifies the DC field gradient to increase the high ion mass cut-off.

38 Claims, 9 Drawing Sheets

TAPERED OR TILTED ELECTRODES TO ALLOW THE SUPERPOSITION OF INDEPENDENTLY CONTROLLABLE DC FIELD GRADIENTS TO RF FIELDS

BACKGROUND OF THE INVENTION

1. Field of the Invention

This invention pertains to a system and method for efficient ion transport of ions having a wide range of masses. More specifically, a DC voltage gradient is generated which does not suffer from mass discrimination.

2. State of the art

One mass spectrometer subsystem which precedes a mass spectrometer is an ion transport system. This application incorporates by reference the materials in U.S. Pat. application Ser. No. 08/751,509 which teaches an improved mass spectrometer.

One example of the state of the art in ion transport via an electrode path is accomplished as shown in FIG. 1A. Here, a system 8 is comprised of four electrodes 10, where one electrode 10 is obscured by another in this view. The obscured electrode is visible in FIG. 1B when the system 8 is viewed on end. In FIG. 1A, the path 12 an ion 14 travels is shown as indicated to be generally along with and parallel to a lengthwise quadrapole axis 18 of the electrodes 10. The electrodes 10 are charged with an RF component. The RF component is provided so that ions are confined in the radial direction relative to the lengthwise axis 18 of the quadrapole system 8.

The system 8 shown in FIG. 1A is known as an RF quadrapole because of the four electrodes 10 which generate the RF field for confining ions in the radial direction. However, other electrode configurations are also present in the state of the art, such as six (hexapole) or eight (octapole) electrode systems. All function similarly in that the systems provide confinement in the radial direction. However, for ions 14 traveling near the axis of the system 8, the effect of higher order RF fields created by a greater number of electrodes is minimal. That is, the electrodes 10 exert their focusing action further from the axis 18 of the system 8. Therefore, while the drawbacks associated with a quadrapole system 8 will be examined closely, it should not be construed as an indication that higher order RF fields provide any significant differences relative to the quadrapole which is discussed in detail hereinafter.

FIG. 1B is provided to show that the electrodes 10 (FIG. 1A) are arranged such that they are generally positioned at four corners of a square. This means that the distance from any electrode 10 to the nearest two electrodes is generally equidistant for each of the electrodes.

Generating a DC axial field gradient is useful when it is desirable to accelerate ions axially along the quadrapole axis 18. The DC field gradient is also useful in overcoming drag forces arising from the presence of background gas which may be present along the ion path.

A first method for generating the DC axial field gradient is through biasing endcaps 6 of the quadrapole system 8. Endcaps 6 provide the DC bias or field gradient necessary to propel the ions 14 along the path 12, while the ions 14 are confined generally to the center of the system 8 by the RF fields. Endcaps 6 are typically conductive plates which have a DC voltage applied thereto.

FIG. 2 is provided to show a perspective view of a distal end of the system of FIG. 1A in the prior art for generating a DC axial field using a single large endcap plate 4 in the shape of a disk. In order to create the DC voltage gradient, a different DC voltage must be applied to each endcap plate 4. FIG. 2 shows only one endcap plate 4, and another endcap plate 4 (not shown) is thus disposed at a proximal end of the system 8. Each endcap plate 4 includes an aperture 2 generally at a center point to allow entry or exit of an ion 14 therethrough. A problem with endcaps, however, is that they generate DC fields only at the proximal and distal ends of the system 8. Consequently, the DC field along a significant length generally near a midpoint of the system 8 is disadvantageously weak.

Another method of improving ion transport performance is to generate stronger DC field gradients. This is accomplished by tilting or tapering the electrodes 10 in conjunction with a DC biasing scheme. Tilting and tapering electrodes 10 enables the DC axial field to have a greater influence on ions 14 by bringing the DC axial field physically closer to the ion path 12 (FIG. 1).

FIGS. 3A and 3B illustrate this method of using tilted electrodes as taught in the prior art. FIG. 3A shows the electrodes 20, 22, 24 and 26 at an arbitrarily selected distal end of the system 8. FIG. 3B shows the same electrodes 20, 22, 24 and 26 at a proximal end of the system 8. By changing from a "flattened diamond" shape in FIG. 3A to a "thin diamond" shape in FIG. 3B, a DC field gradient is created with reference to the quadrapole axis 18. The DC field gradient is generated by a DC bias applied between pairs of electrodes 20, 22, 24 and 26. The applied RF voltages are indicated within the electrodes 20, 22, 24 and 26. The polarity of the DC axial gradient voltages are indicated outside each of the same electrodes.

A significant drawback to the method described above is that in addition to an axial DC electrical field, a quadrapolar DC field is disadvantageously generated. The effect of the quadrapolar DC field is summarized as introduction of mass discrimination. More specifically, mass/charge discrimination occurs in that a narrower range of ions can be transported via the electrodes 20, 22, 24 and 26, where the range of ions is determined by the mass thereof. To increase an axial acceleration field, a stronger DC field gradient is required. However, the disadvantage is that increasing the strength of the DC gradient results in a corresponding increase in the undesirable quadrapolar DC field.

While a quadrapolar configuration which only has radio frequency energy applied thereto has a theoretical low ion mass cut-off, there is no high ion mass cut-off. However, the addition of the quadrapolar DC field introduces a high ion mass cut-off. In applications requiring a large passband, this high ion mass cut-off is unavoidable in the prior art. This is because the magnitude and sign of the quadrapolar DC field varies with axial position. Therefore, it is not possible to compensate by superpositioning an additional quadrapolar DC field on the system 8.

Accordingly, it would be an advantage over the prior art to reduce mass discrimination by eliminating the quadrapolar DC field. It would be a further advantage to be able to manipulate the RF quadrapolar, the DC quadrapolar and the DC axial fields independently of each other.

OBJECTS AND SUMMARY OF THE INVENTION

It is an object of the present invention to provide a method and apparatus for transporting ions via controllable DC electrical field gradients.

It is another object to provide an improved mass spectrometer system by improving performance of the ion transport system which precedes a mass spectrometer.

It is another object to provide a method and apparatus for eliminating undesirable quadrapolar DC fields in a transport system.

It is another object to provide a method and apparatus for applying RF and DC electrical fields so as to cancel the quadrapolar DC field.

It is another object to provide a method and apparatus for an ion transport system which cancels quadrapolar DC fields by a symmetry of the system configuration.

It is another object to provide a method and apparatus for eliminating undesirable quadrapolar DC fields by doubling the number of electrodes by creating electrode pairs.

It is another object to provide a method and apparatus for increasing a passband of the DC field gradient to thereby enable ions of higher mass to be transported.

The present invention is embodied in a method and apparatus for transporting ions via a path generated by RF electrodes having a controllable DC field gradient generated thereon which does not suffer from mass discrimination.

In one aspect of the present invention, the number of electrodes are doubled to thereby use symmetry to cancel an undesirable DC quadrapolar field. By eliminating the DC quadrapolar field, ions of higher mass can be transported.

In another aspect of the invention, the electrodes are tilted to thereby generate a desirable DC field gradient. Tilting the electrodes advantageously modifies the DC field gradient without introducing an undesirable quadrapolar field.

In another aspect of the invention, the electrodes are tapered to thereby generate a desirable DC field gradient. Tapering the electrodes advantageously modifies the DC axial field gradient without lowering the high mass cut-off.

In another aspect of the invention, the electrodes are disposed so as to be titled, as well as being formed to be tapered to thereby generate a desirable DC field gradient. Tapering and tilting the electrodes advantageously modifies the DC axial field gradient without lowering the high mass cut-off.

These and other objects, features, advantages and alternative aspects of the present invention will become apparent to those skilled in the art from a consideration of the following detailed description taken in combination with the accompanying drawings.

DETAILED DESCRIPTION OF THE INVENTION

Reference will now be made to the drawings in which the various elements of one preferred embodiment of the present invention will be given numerical designations and in which the preferred embodiment of the invention will be discussed so as to enable one skilled in the art to make and use the invention.

Figure 4:
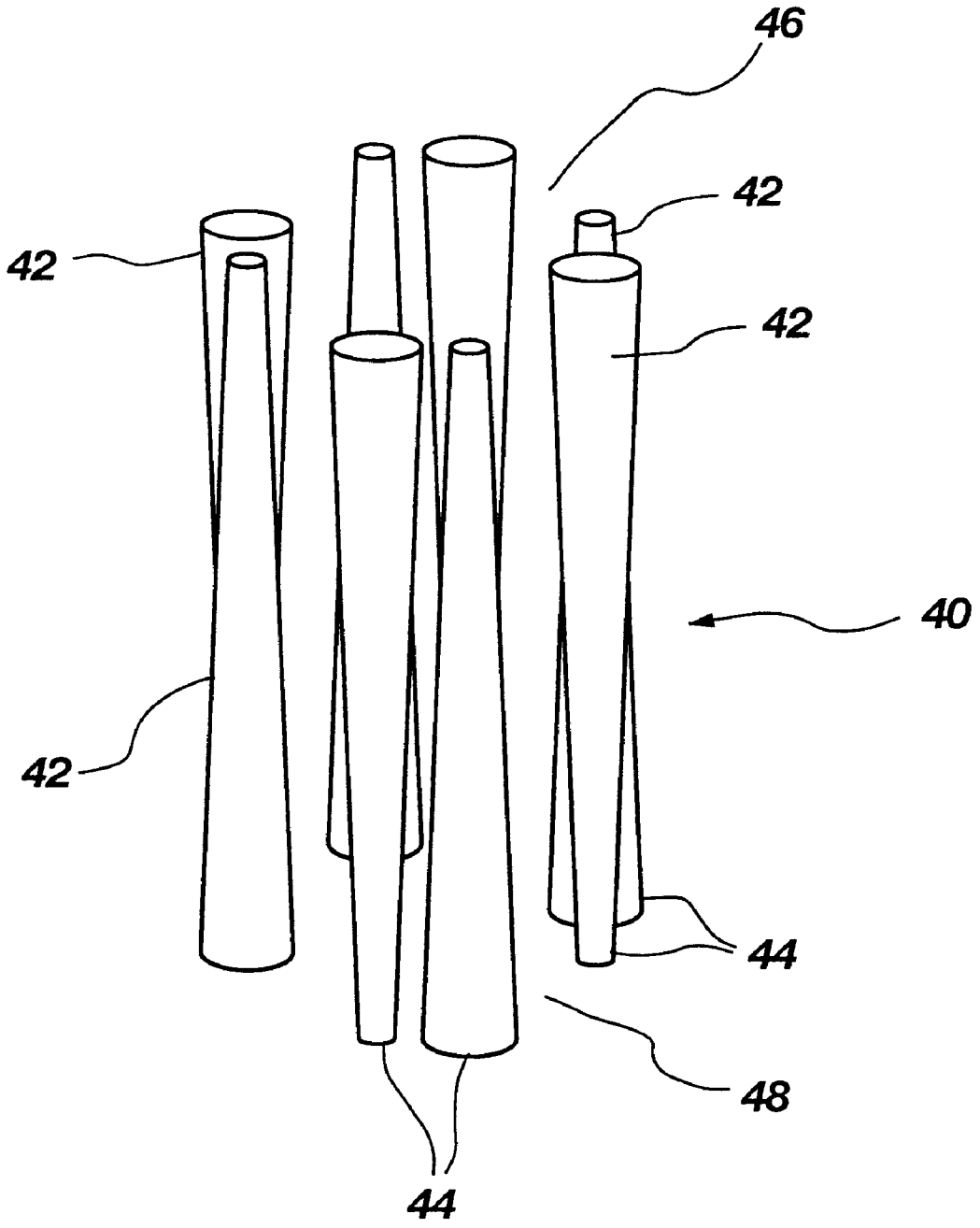
FIG. 4 is a perspective view of the presently preferred embodiment made in accordance with the present invention, wherein the electrodes of a quadrapole ion transport are disposed in tapered electrode pairs.

The preferred embodiment of the present invention is embodied in an ion transport system utilizing a plurality of tapered electrodes to independently control DC field gradients and RF fields. Shown in FIG. 4, the preferred embodiment is an ion transport device which accelerates ions using an axial DC gradient field generated within a modified quadrapole configuration 40 of electrodes.

Figure 1A:
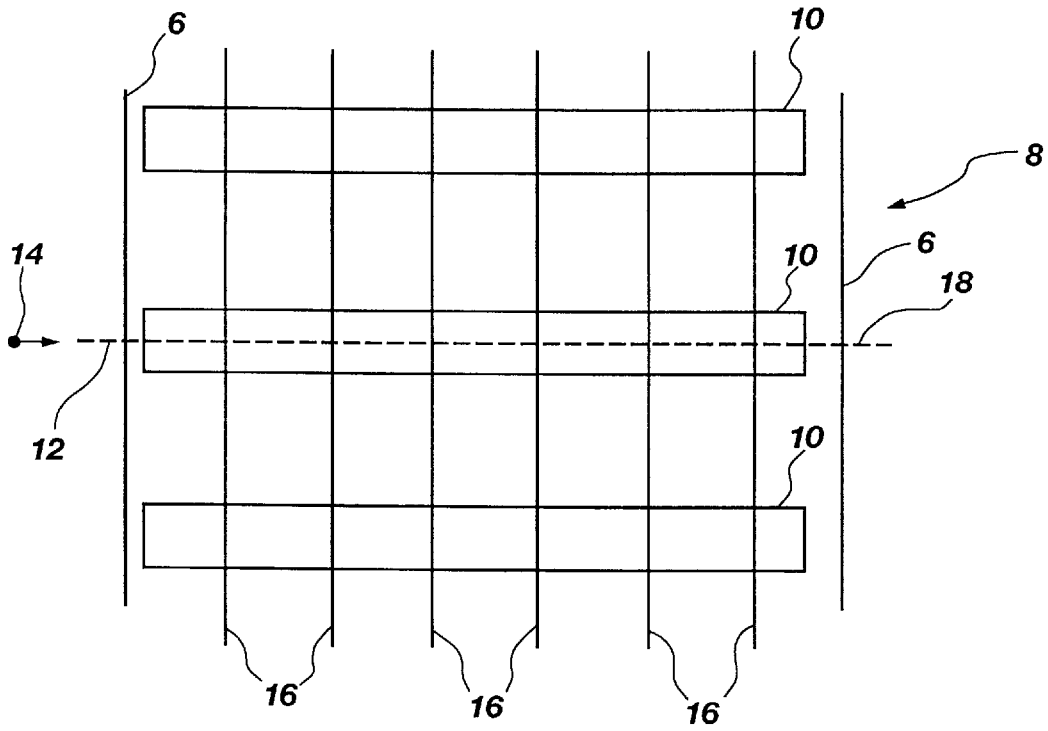
Fig.1A (PRIOR ART)
FIG. 1A is a profile illustration of a prior art quadrapole ion transport system which creates a DC axial field gradient using endcaps to bias the electrodes and to thereby transport ions.
Figure 1B:
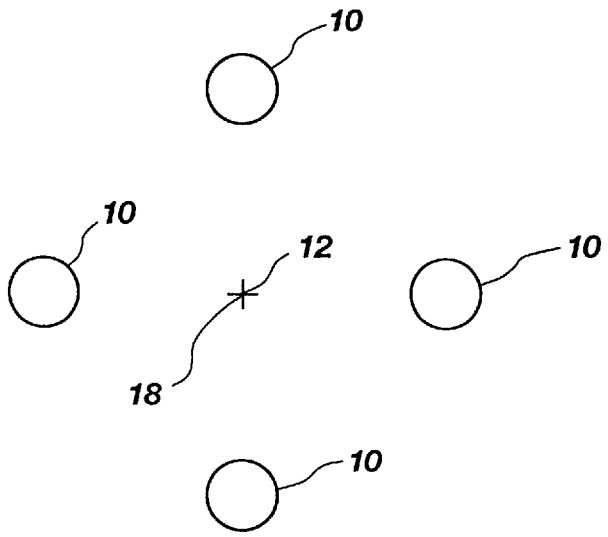
Fig.1B (PRIOR ART)
FIG. 1B is an end view illustration of the quadrapole system of FIG. 1A which shows a configuration of electrodes without endcaps and arranged as an ion transport system.
Figure 2:
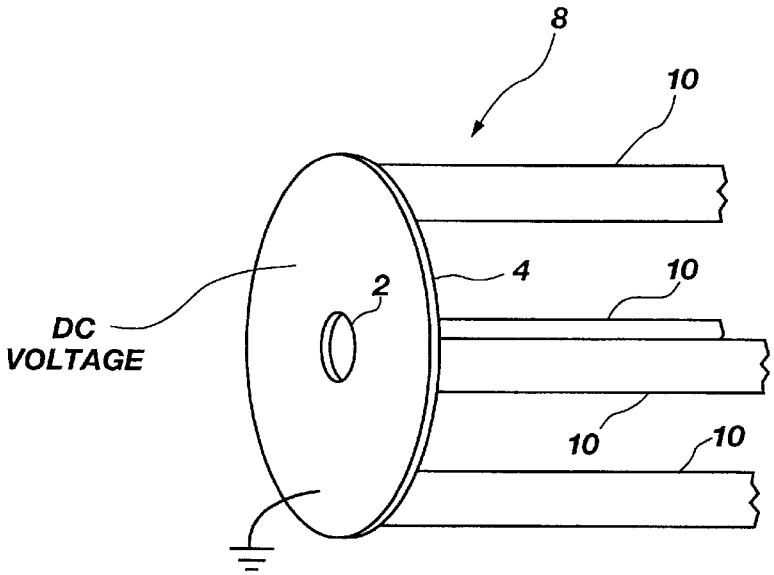
Fig. 2 (PRIOR ART)
FIG. 2 is a perspective view of the system from the prior art shown in FIG. 1.
Figure 3A:
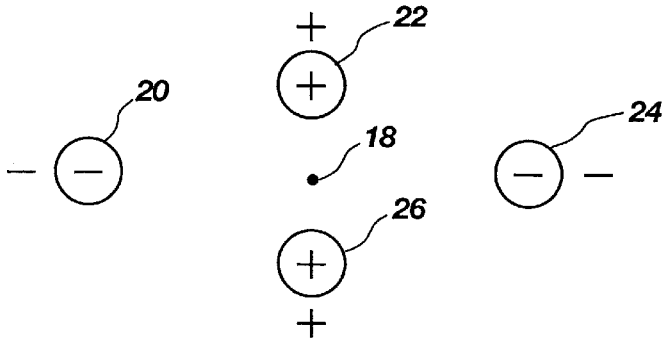
Fig. 3A (PRIOR ART)
FIG. 3A is an illustration of another system in the prior art for an ion transport system as seen from a distal end view perspective which shows that the system is tilting the electrodes to achieve improved ion transport characteristics.
Figure 3B:
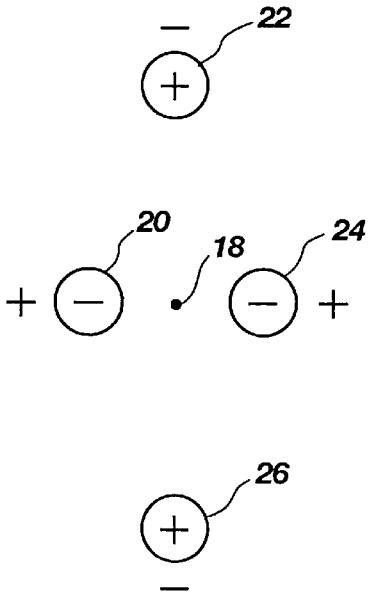
Fig. 3B (PRIOR ART)
FIG. 3B is an illustration of another system in the prior art of the ion transport system of FIG. 3A, but as seen from the perspective of a proximal end.
Figure 2A:
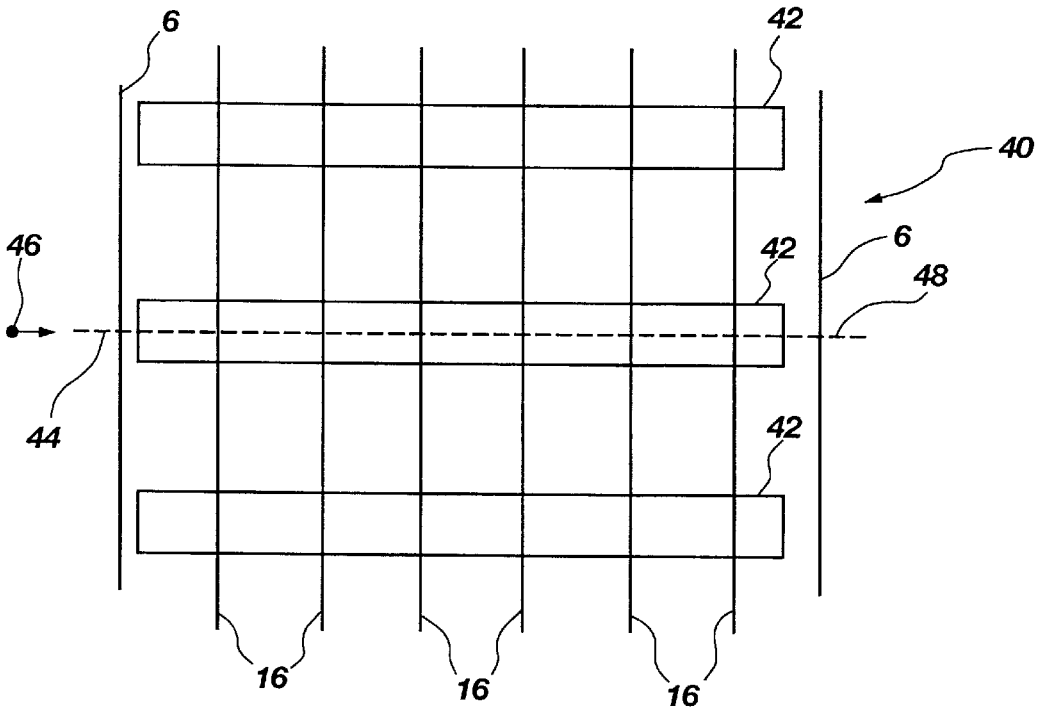
Fig. 2A (PRIOR ART)
Figure 2B:
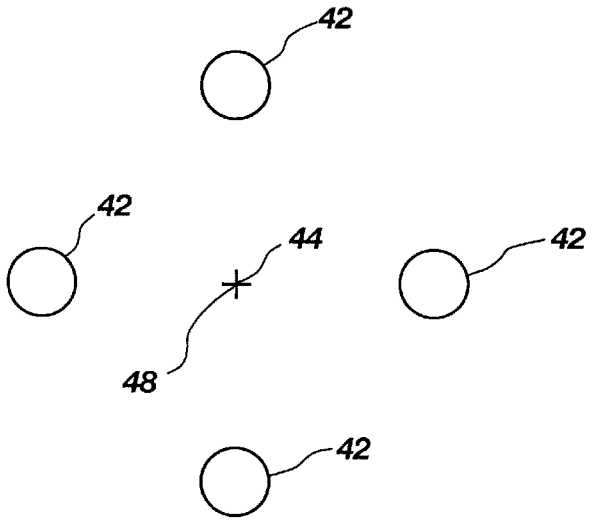
Fig. 2B (PRIOR ART)

The modified quadrapole system 40 has twice the number of electrodes 42 than a quadrapole system 8 (see FIG. 1) of the prior art. What is important to observe about the modified system 40 is the symmetry which exists in the quadrapole electrode pairs 44. In the preferred embodiment, the quadrapole electrode pairs 44 taper in opposite directions. One electrode 42 of the electrode pair 44 tapers from its widest cross section beginning at an arbitrarily selected distal end 46 of the system 40 down to its narrowest cross section ending at a proximal end 48 of the system 40. Accordingly, to taper in the opposite direction, the other electrode 42 of the electrode pair 44 has its narrowest cross section at the distal end and widens out to its widest cross section at the proximal end of the system.

Before describing the system 40 further, it is useful to make some observations about the electrode pair 44. First, each electrode 42 of the electrode pair 44 has applied thereto a radio frequency (RF) voltage and a direct current (DC) voltage. Each electrode 42 in an electrode pair 44 has a same RF voltage applied thereto. As explained, the RF voltage is applied to the electrode pair in order to confines ions in the radial direction within the system 40. However, while electrodes 42 within a same electrode pair have the same polarity, adjacent electrode pairs 44 have applied thereto RF voltages which are always opposite in polarity.

In contrast, DC voltages are applied in order to generate an axial DC electrical field in conjunction with the other electrode pairs 44 of the system 40. In order to create an electrical potential between the distal end and the proximal end of the system 40, the distal end and the proximal end must be oppositely charged. The DC voltages applied to the electrode pairs 44 are consistently applied. This means that unlike the RF voltage where a voltage of the same polarity is applied to both electrodes 42 within the electrode pairs 44, one electrode 42 always has a positive DC voltage applied thereto, and the other electrode 42 of the electrode pair 44 always has a negative DC voltage. Applying the DC voltages consistently means that all electrodes 42 having a same cross section width at the distal end have the same DC voltage in order to generate the axial DC field gradient required to accelerate ions. The choice of whether to apply a positive or negative DC voltage polarity depends upon the application of the ion transfer system, as will be understood by those skilled in the art. Nevertheless, a specific example will be provided later.

Figure 5A:
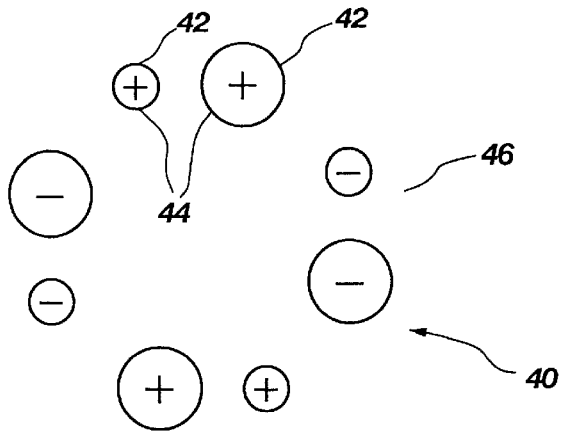
FIG. 5A is a distal end view of a tapered pair ion transport quadrapole system shown with RF voltages applied.
Figure 5B:
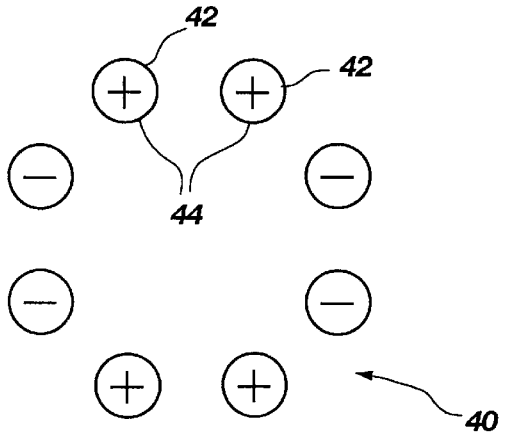
FIG. 5B is a cross sectional view of a midpoint of the system of FIG. 5A with RF voltages applied.
Figure 5C:
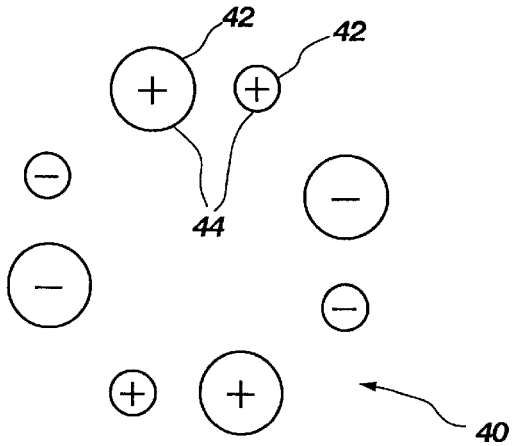
FIG. 5C is a proximal end view of the system shown in FIG. 5A with RF voltages applied.

FIGS. 5A, 5B, 5C, 6A, 6B and 6C provide a much more complete illustration of how the RF and DC voltages are applied to the preferred embodiment of the system 40. FIGS. 5A and 5C are end views of the system shown 40 in FIG. 5. FIG. 5A is arbitrarily assigned to illustrate the distal end 46 of the system 40, and FIG. 5C is accordingly assigned to illustrate the proximal end 48 of the system 40. FIG. 5B therefore illustrates approximately a cross section of the electrodes 42 of the system 40 at a midpoint between the distal end 46 and the proximal end 48.

FIG. 5A not only illustrates the arrangement of the electrodes 42 of the system 40, but also explicitly shows how the RF voltages are applied to the electrodes 43 and the electrode pairs 44. As previously explained, a same RF voltage is applied to both electrodes 42 in an electrode pair 44. However, adjacent electrode pairs 44 must always have an RF voltage of opposite polarity applied thereto.

FIG. 5B illustrates the same applied RF voltages as in FIG. 5A, but that at the midpoint of the electrodes 42, the diameter of the electrodes 42 is generally the same.

Finally, FIG. 5C illustrates the same applied RF voltages as in FIGS. 5A and 5B, but that the cross sectional width of the electrodes 42 is reversed from that of FIG. 5A.

Figure 6A:
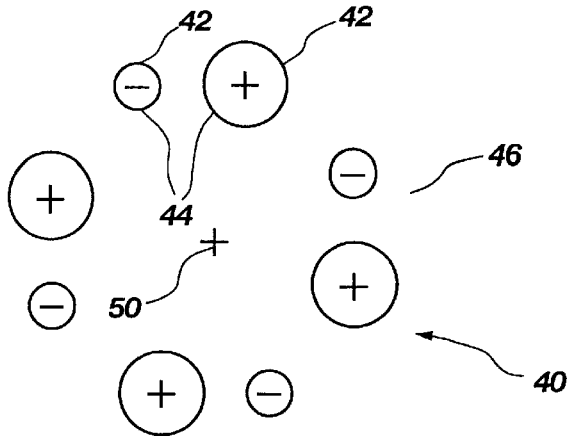
FIG. 6A is a distal end view of a tapered pair ion transport quadrapole system shown with DC voltages applied.
Figure 6B:
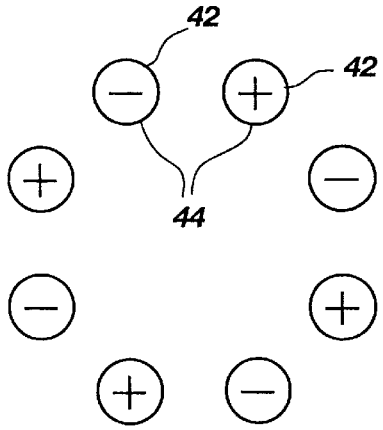
FIG. 6B is a cross sectional view of a midpoint of the system of FIG. 6A with DC voltages applied.
Figure 6C:
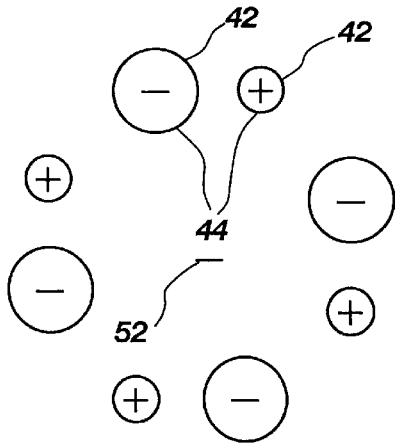
FIG. 6C is a proximal end view of the system shown in FIG. 6A with DC voltages applied.

FIGS. 6A, 6B and 6C show identical cross sectional widths of the electrodes 42 shown in FIGS. 5A, 5B and 5C. The important distinction made by the new figures is that they now show the applied DC voltages. The axial DC field gradient is caused by the DC bias voltages applied to the electrodes 42 of the system 40. As stated previously, the DC voltages are applied differently than the RF voltages. In each electrode pair 44, one electrode has a negative DC polarity, and one has a positive DC polarity. The result is that an axial DC voltage gradient is generated. Identifying the polarity of the DC field gradient is a matter of examining which DC voltage is greater at the distal end 46, the midpoint and the proximal end 48.

FIG. 6A illustrates that all of the electrodes 42 which have the widest cross sectional area have a positive DC voltage applied thereto. Consequently, the axial DC field gradient is biased positive 50 at the distal end 46. In the same manner, there is generally no DC bias at the midpoint shown in FIG. 7B. This is because the DC voltages generally cancel each other out. However, at the proximal end 48 illustrated by FIG. 6C, the axial DC field gradient is biased negative 52 for the same reason that the proximal end 46 is biased positive 50.

It is now possible to summarize a few of the advantages of the preferred embodiment of the present invention. Specifically, the number of electrodes in a system is doubled so that all isolated electrodes of the prior art become electrode pairs. The next step is to taper each of the electrode pairs so that when DC voltage is applied, the electrodes create a biased DC voltage gradient. Owing to the very nature of the arrangement of electrodes, the undesirable DC quadrapolar field is advantageously eliminated. However, both the RF quadrapolar field and the axial DC field are present. What is not readily apparent is that ion mass discrimination is substantially minimized. By introducing an axial DC field gradient without creating the quadrapolar field, the ion mass passband is substantially increased, allowing more massive ions to be transported by the system. As a consequence, it is also more likely that systems using longer electrodes can now be used for ion transport.

While the preferred embodiment teaches how to modify a quadrapole configuration, the principles are applicable to higher order electrode configurations as well. Therefore, if an octapole configuration were created, doubling the electrodes would generate a system having 16 electrodes.

Another modification to the present invention relates to the doubling of all electrodes. The electrodes can also be quadrupled to create a plurality of quadrapole groups, each group functioning in place of a single electrode of an unmodified quadrapole ion transport configuration.

In an alternative embodiment of the present invention, the electrodes can all be of substantially uniform cross sectional width. Therefore, to obtain a desired axial DC field gradient, the electrodes are tilted so as not to be parallel with a common system axis.

Figure 7A:
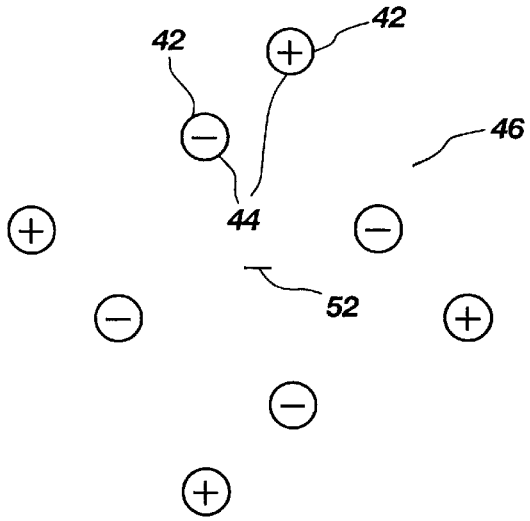
FIG. 7A is a distal end view of an alternative embodiment of the present invention including a tilted pair ion transport quadrapole system shown with DC voltages applied and an overall bias of the distal end indicated as being of lower voltage potential than a proximal end shown in FIG. 7C.
Figure 7B:
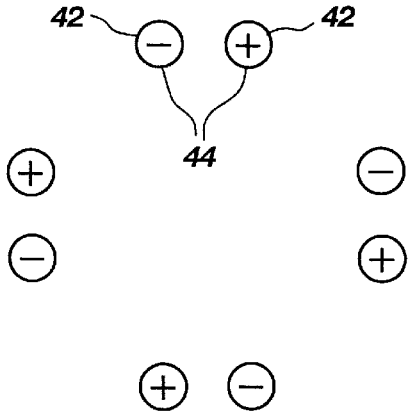
FIG. 7B is a cross sectional view of a midpoint of the system of FIG. 7A with DC voltages applied.
Figure 7C:
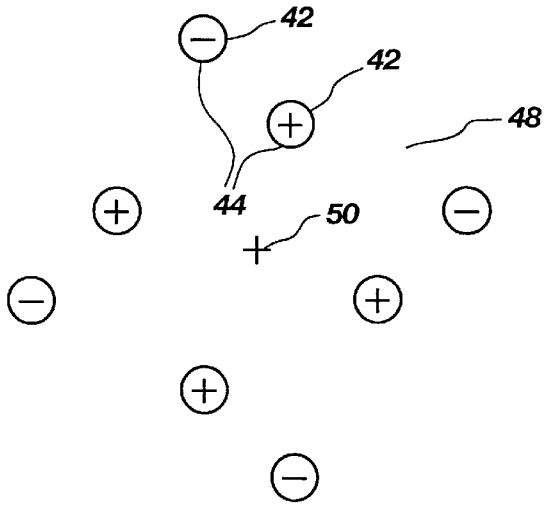
FIG. 7C is the proximal end view of the system shown in FIG. 7A with DC voltages applied and an overall bias of the proximal end indicated as being of higher voltage potential than the distal end shown in FIG. 7A.

FIGS. 7A, 7B and 7C illustrate the alternative embodiment. Specifically, electrodes 42 are now tilted toward or away from a common axis. If FIG. 7A illustrates the distal end 46 of the system 40, and the voltages applied to the electrodes 42 are DC voltages, then the axial DC field gradient will be biased negative 52 because although the electrodes now all have uniform cross sections, the negatively charged electrodes are tilted towards the common axis and therefore have a greater affect upon the DC bias at the distal end 46. FIG. 7B shows that at a midpoint, the positive and negative DC voltages balance so as the render neutral any DC bias. Finally, FIG. 7C shows that at the proximal end 48 of the system 40, the positively charged electrodes 42 are now nearest to the common axis. Therefore, the proximal end 48 is biased positively 50.

It should also be apparent, however, that the DC voltage polarities can be switched so as to reverse the DC voltage biasing on the system 40. Furthermore, it should also be apparent that the cross section of the electrodes 42 can be any ellipsoid or polygon which is desired, as long as the cross sectional area is consistent along the length of the electrodes. Maintaining the cross sectional area uniform maintains a uniform electrical potential across the electrodes 42 so that the biasing effects are all achieved as a result of tilting the electrodes 42.

Figure 8:
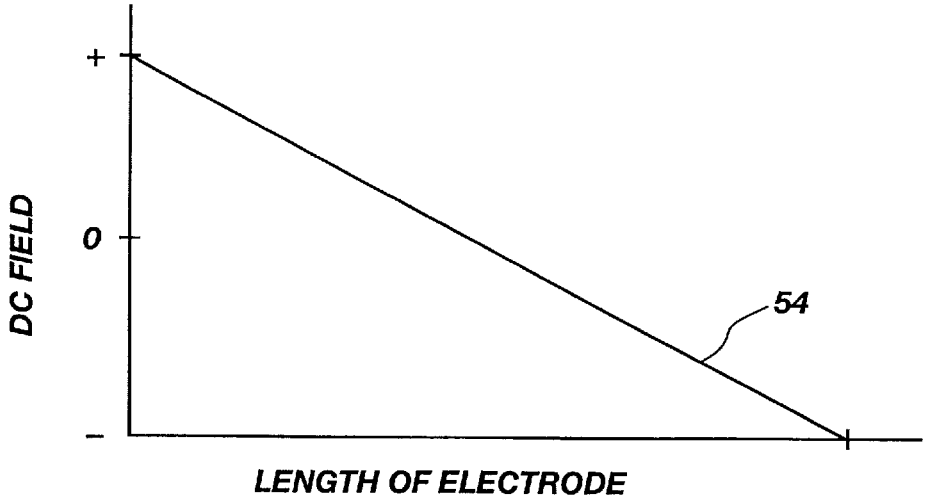
FIG. 8 is a graph showing the performance of the present invention ion transport system of FIGS. 5, 6 and 7, which is used to illustrate DC field strength along the quadrapolar axis.

FIG. 8 is a graph of the resulting DC electrical field of either the preferred or the alternative embodiment of the present invention. Axial DC field polarity is shown in FIG. 8 and indicated at line 54. The significant feature to observe is that the axial DC field is generally a linear gradient between the ends of the electrodes.

The preferred embodiment of the present invention has disclosed applying a positive DC voltage to the first electrode and applying a negative DC voltage to the second electrode of each of the at least four electrode pairs which comprise the quadrapole system. However, it should be apparent that in an alternative embodiment, it is advantageously possible to apply positive DC voltages to both of the electrodes in each of the at least four electrode pairs. Conversely, it is also possible to apply negative voltages to both of the electrodes in each of the at least four electrode pairs. In other words, the at least four electrodes pairs can be positively or negatively biased and still function as described. What is important is that the first electrode and the second electrode have different DC voltages applied to them to create the DC axial field gradient.

Another observation to make is that the electrodes 42 (FIG. 4) are shown as having a cylindrical cross section, typical of a truncated cone. It should be apparent that the shape of the electrodes is not limited to a cylindrical cross section. In other words, the cross section of the electrodes 42 can be an ellipsoid, a polygon, or a combination of the two. What is important is that the electrodes 42 must be tapered along their length so as to provide a DC field gradient along the length of the system 40. A uniform change in the DC field gradient would most likely be obtained by tapering electrodes 42 generally uniformly in width by creating a linear slope.

Figure 9A:
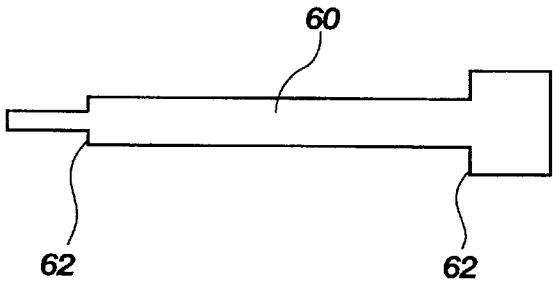
FIG. 9A is a profile view of an alternative embodiment of an electrode which is tapered using discrete steps.
Figure 9B:
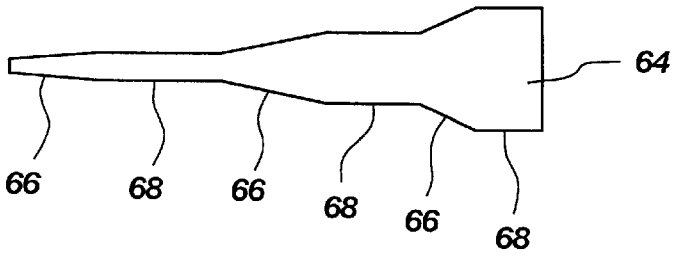
FIG. 9B is a profile view of an alternative embodiment of an electrode which is tapered using linear slopes and horizontal regions.

However, it should be realized that a linear DC axial field gradient may not be desired. Consequently, a curved DC axial field gradient can be obtained through monotonically tapered electrodes 42. To illustrate this concept more clearly, FIGS. 9A and 9B are provided to show alternative methods of tapering electrodes. Specifically, FIG. 9A shows a tapered electrode 60 which is tapered using a plurality of discrete steps 62. Obviously, the number of discrete steps can be modified as desired.

In contrast, FIG. 9B shows an electrode 64 which has a plurality of generally linear sloping regions 66 having a plurality of generally linear regions 68 inbetween. It should be obvious that the generally linear sloping regions 66 of FIG. 9B can be intermixed with the generally discrete steps 62 of FIG. 9A as desired.

Another important aspect of the present invention is that it is also possible to combine the aspects of tilting and tapering of the electrodes in a single quadrapole system. The combination of tilted and tapered electrodes provides a quadrapole system which is generally capable of generating even stronger DC axial field gradients than either the titling or tapering structure alone can accomplish.

It is to be understood that the above-described embodiments are only illustrative of the application of the principles of the present invention. Numerous modifications and alternative arrangements may be devised by those skilled in the art without departing from the spirit and scope of the present invention. The appended claims are intended to cover such modifications and arrangements.

Figure 10:
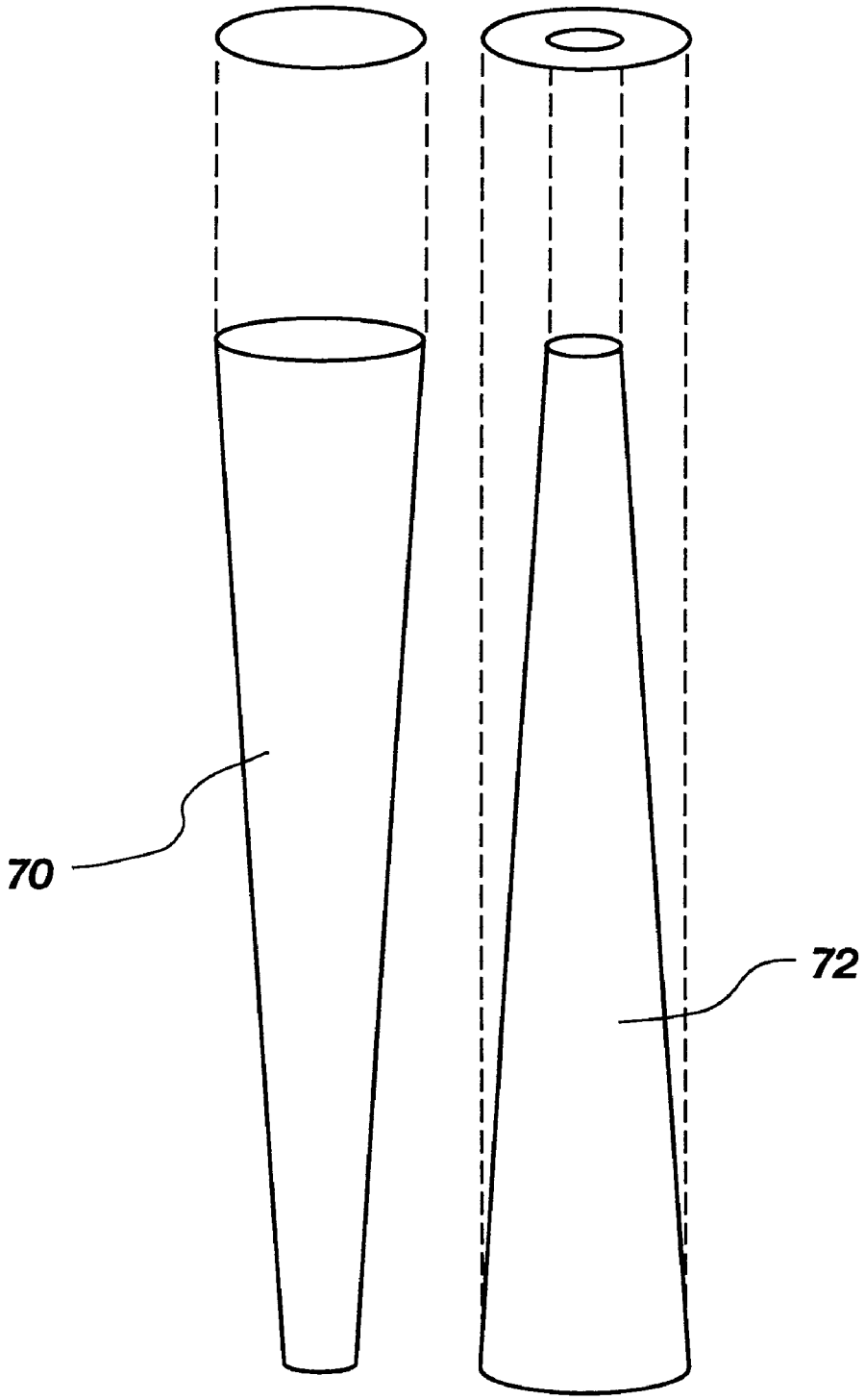
FIG. 10 is both a perspective view of a pair of electrodes where the electrodes are oppositely tapered with respect to each other, and a top view of these same electrodes as indicated by dashed lines.

FIG. 10 is provided to illustrate in a perspective drawing, a single pair of electrodes 70, 72 which are oppositely tapered. The new feature which is also shown is that the electrodes now have a cross section which is not circular. As stated previously, the cross section can be an ellipsoid or polygon. In this view, the cross section is shown as one type of ellipsoid in a top view as indicated by the dashed lines which lead from the perspective view to the top view of the electrodes 70, 72.

What is claimed is:

1. An ion transport system utilizing radio frequency (RF) voltage and direct current (DC) voltage to accelerate ions along a preselected path from a distal end toward a proximal end of the ion transport system, wherein electrode pairs are created to thereby at least partially cancel undesirable quadrapolar DC fields, said ion transport system comprising:

at least four pairs of electrodes disposed generally equidistant from adjacent electrode pairs disposed about a common axis, wherein each pair of the at least four pairs of electrodes is comprised of tapered and generally parallel electrodes, and wherein each pair of the at least four pairs of electrodes are comprised of:

a first electrode having a larger cross section at the distal end than at the proximal end; and a second electrode having a smaller cross section at the distal end than at the proximal end, wherein a nearest electrode of a nearest pair of electrodes is oppositely tapered relative to the second electrode, wherein the first and the second electrodes form an oppositely tapered electrode pair which at least partially cancels quadrapolar DC fields generated therefrom, and wherein the tapering of each electrode is at least one generally discrete step inward or outward from a central axis of each electrode pair, corresponding to an inward or outward direction of tapering, respectively.

2. The ion transport system as defined in claim 1 wherein a positive RF voltage is applied to the first electrode and to the second electrode of the first pair of the at least four pairs of electrodes, and wherein a negative RF voltage is applied to the first electrode and to the second electrode of a second pair of the at least four pairs of electrodes, and wherein an oppositely charged RF voltage is applied to a next subsequently adjacent pair of electrodes of the at least four pairs of electrodes, until each of the at least four pairs of electrodes has an RF voltage applied thereto.

3. The ion transport system as defined in claim 2 wherein a higher DC voltage is applied to the first electrode of each of the at least four pairs of electrodes relative to a lower DC voltage which is applied to the second electrode of each of the at least four pairs of electrodes.

4. The ion transport system as defined in claim 3 wherein the cross section of each electrode of the at least four pairs of electrodes is selected from the group of cross sections consisting of ellipsoids and polygons.

5. The ion transport system as defined in claim 4 wherein the system has a higher DC voltage at the distal end of the system relative to a lower DC voltage at the proximal end of the system, or a lower DC voltage at the distal end of the system relative to a higher DC voltage at the proximal end of the system, depending on a direction of ion transport and polarity of ions.

6. The ion transport system as defined in claim 5 wherein the system has a DC voltage generally at a midpoint between the proximal end and the distal end of the system which is generally an average of the DC voltages at the distal end and the proximal end.

7. The ion transport system as defined in claim 3 wherein a DC bias is applied to the first electrode and the second electrode of the at least four pairs of electrodes.

8. The ion transport system as defined in claim 1 wherein a total number of electrode pairs of the system is always an even number to thereby generate higher order RF fields.

9. The ion transport system as defined in claim 1 wherein the tapering of each electrode of the at least four pairs of electrodes is at least one generally discrete step inward or outward from a central axis of each electrode, combined with a continuous inward or outward sloping taper, corresponding to an inward or outward direction of tapering, respectively.

10. The ion transport system as defined in claim 1 wherein the tapering of each electrode of the at least four pairs of electrodes is a continuous inward or outward sloping taper, corresponding to an inward or outward direction of tapering, respectively.

11. The ion transport system as defined in claim 1 wherein the at least four pairs of electrodes are caused to tilt such that the first electrode is tilted toward the common axis at the distal end of the system and tilted away from the common axis at the proximal end of the system, and the second electrode is titled away from the common axis at the distal end of the system and tilted toward the common axis at the proximal end of the system.

12. An ion transport system utilizing radio frequency (RF) voltage and direct current (DC) voltage to accelerate ions along a preselected path from a distal end toward a proximal end of the ion transport system, while at least partially canceling undesirable quadrapolar DC fields, said ion transport system comprised of:

at least four pairs of electrodes disposed generally equidistant from adjacent electrode pairs about a common axis, wherein each pair of the at least four pairs of electrode is comprised of:

a first electrode which is tilted toward the common axis at the distal end of the system and tilted away from the common axis at the proximal end of the system; and a second electrode which is titled away from the common axis at the distal end of the system and tilted toward the common axis at the proximal end of the system, wherein the cross section of each electrode in the at least four pairs of electrodes is selected from the group of cross sections consisting of ellipsoids and polygons, and wherein the first and the second electrode form an electrode pair which at least partially cancels quadrapolar DC fields.

13. The ion transport system as defined in claim 12 wherein a positive RF voltage is applied to the first electrode and to the second electrode of a first pair of the at least four pairs of electrodes, and wherein a negative RF voltage is applied to the first electrode and to the second electrode of a second pair of the at least four pairs of electrodes, and wherein an oppositely charged RF voltage is applied to a next subsequently adjacent pair of electrodes of the at least four pairs of electrodes, until each of the at least four pairs of electrodes has an RF voltage applied thereto.

14. The ion transport system as defined in claim 13 wherein a higher DC voltage is applied to the first electrode of each of the at least four pairs of electrodes relative to a lower DC voltage applied to the second electrode of each of the at least four pairs of electrodes.

15. The ion transport system as defined in claim 14 wherein the system has a higher DC voltage at the distal end of the system relative to a lower DC voltage at the proximal end of the system, or a lower DC voltage at the distal end of the system relative to a higher DC voltage at the proximal end of the system, depending on a direction of ion transport and polarity of ions.

16. The ion transport system as defined in claim 15 wherein the system has a DC voltage generally at a midpoint between the proximal end and the distal end of the system which is generally an average of the DC voltages at the distal end and the proximal end.

17. The ion transport system as defined in claim 14 wherein a DC bias is applied to the first electrode and the second electrode of the at least four pairs of electrodes.

18. The ion transport system as defined in claim 12 wherein a total number of electrode pairs of the system is always an even number to thereby generate higher order DC fields.

19. The ion transport system as defined in claim 12 wherein each pair of the at least four pairs of electrodes is comprised of tapered and generally parallel electrodes, and wherein the first electrode has a larger cross section at the distal end than at the proximal end, and wherein the second electrode has a smaller cross section at the distal end than at the proximal end, and wherein a nearest electrode of a nearest pair of electrodes is oppositely tapered relative to the second electrode.

20. A method for transporting ions utilizing radio frequency (RF) voltage and direct current (DC) voltage to accelerate ions along a preselected path from a distal end toward a proximal end, wherein the method improves ion transport by at least partially canceling undesirable quadrapole DC fields, said method comprising the steps of:

(a) providing at least four pairs of electrodes disposed so as to be generally equidistant from adjacent electrode pairs about a common axis which generally defines the preselected path for the ions, wherein each pair of the at least four pairs of electrodes are oppositely tapered relative to each other using at least one generally discrete step inward or outward from a central axis of each electrode, corresponding to an inward or outward direction of tapering, respectively; and (b) applying RF voltages and DC voltages to the at least four electrode pairs so as to at least partially cancel undesirable quadrapolar DC fields and thereby decrease ion mass discrimination and improve ion transport.

21. The method for transporting ions as defined in claim 20 wherein the step of applying RF voltages and DC voltages to thereby decrease ion mass discrimination comprises the more specific step of increasing axial DC field strength without generating the DC quadrapole field.

22. The method for transporting ions as defined in claim 20 wherein the method comprises the more specific step of overcoming a drag force on ions due to presence of a gas along the preselected path.

23. The method for transporting ions as defined in claim 20 wherein the method comprises the more specific step of increasing an ion passband by increasing a high ion mass cut-off.

24. The method for transporting ions as defined in claim 20 wherein the step of providing at least four pairs of electrodes disposed so as to be generally equidistant from adjacent electrode pairs about a common axis is more specifically comprised of the step of tapering each of the electrodes to provide an essential electrode symmetry.

25. The method for transporting ions as defined in claim 24 wherein the step of providing an essential electrode symmetry comprises the more specific steps of:

(a) tapering a first electrode to thereby have a larger cross section at the distal end than at the proximal end; and (b) tapering a second electrode to thereby have a smaller cross section at the distal end than at the proximal end, such that a nearest electrode of a nearest adjacent pair of electrodes is oppositely tapered relative to the second electrode.

26. The method for transporting ions as defined in claim 25 wherein the step of applying RF voltages to the at least four electrode pairs comprises the more specific steps of:

(a) applying a positive RF voltage to the first electrode and to the second electrode of a first pair of the at least four pairs of electrodes;

(b) applying a negative RF voltage to the first electrode and to the second electrode of a second pair of the at least four pairs of electrodes; and (c) applying an oppositely charged RF voltage to a next subsequently adjacent pair of electrodes of the at least four pairs of electrodes, until each of the at least four pairs of electrodes has an RF voltage applied thereto.

27. The method for transporting ions as defined in claim 26 wherein the step of applying DC voltages to the at least four electrode pairs so as to prevent generating a DC quadrapolar field comprises the more specific steps of:

(a) applying a positive DC voltage to the first electrode of each of the at least four pairs of electrodes; and (b) applying a negative DC voltage to the second electrode of each of the at least four pairs of electrodes, wherein the axial DC field is generated and the DC quadrapole field is eliminated due to the symmetry of the system.

28. The method for transporting ions as defined in claim 27 wherein the step of providing the at least four electrode pairs is more specifically comprised of the step of providing the at least four electrodes, each electrode having a cross section which is an ellipsoid or a polygon.

29. The method for transporting ions as defined in claim 28 wherein the step of providing the at least four electrode pairs is more specifically comprised of the step of always providing an even number of electrode pairs to thereby provide the symmetry necessary to eliminate the DC quadrapole field.

30. The method for transporting ions as defined in claim 20 wherein the step of providing at least four pairs of electrodes disposed so as to be generally equidistant from adjacent electrode pairs about a common axis is more specifically comprised of the step of tilting each of the electrodes to provide an essential electrode symmetry.

31. The method for transporting ions as defined in claim 30 wherein the step of providing an essential electrode symmetry comprises the more specific steps of:

(a) tilting a first electrode toward the common axis at the distal end of the system and tilting the first electrode away from the common axis at the proximal end of the system;

(b) tilting a second electrode away from the common axis at the distal end of the system and tilting the second electrode toward the common axis at the proximal end of the system, such that a nearest first electrode of an adjacent pair of electrodes is tilted oppositely relative to the second electrode.

32. The method for transporting ions as defined in claim 31 wherein the step of applying RF voltages to the at least four electrode pairs comprises the more specific steps of:

(a) applying a positive RF voltage to the first electrode and to the second electrode of a first pair of the at least four pairs of electrodes;

(b) applying a negative RF voltage to the first electrode and to the second electrode of a second pair of the at least four pairs of electrodes; and (c) applying an oppositely charged RF voltage to a next subsequently adjacent pair of electrodes of the at least four pairs of electrodes, until each of the at least four pairs of electrodes has an RF voltage applied thereto.

33. The method for transporting ions as defined in claim 32 wherein the step of applying DC voltages to the at least four electrode pairs so as to prevent generating a DC quadrapolar field comprises the more specific steps of:

(a) applying a positive DC voltage to the first electrode of each of the at least four pairs of electrodes; and (b) applying a negative DC voltage to the second electrode of each of the at least four pairs of electrodes, wherein the axial DC field is generated and the DC quadrapole field is eliminated due to the symmetry of the system.

34. The method for transporting ions as defined in claim 33 wherein the step of providing the at least four electrode pairs is more specifically comprised of the step of providing the at least four electrodes, each electrode having a cross section which is an ellipsoid or a polygon.

35. The method for transporting ions as defined in claim 24 wherein the step of providing the at least four electrode pairs is more specifically comprised of the step of providing an even number of electron pairs to thereby provide the symmetry necessary to eliminate the DC quadrapole field.

36. The method for transporting ions as defined in claim 20 wherein the step of providing the at least four pairs of electrodes includes the steps of:

(1) tapering the electrodes so that each electrode of the at least four pairs of electrodes is tapered using at least one generally discrete step inward or outward from a central axis of each electrode; and (2) also tapering the electrodes so that each electrode of the at least four pairs of electrodes is tapered using a continuous inward or outward sloping taper, corresponding to an inward or outward direction of tapering, respectively.

37. The method for transporting ions as defined in claim 20 wherein the step of providing the at least four pairs of electrodes includes the step of tapering the electrodes so that each electrode of the at least four pairs of electrodes is tapered using a continuous inward or outward sloping taper, corresponding to an inward or outward direction of tapering, respectively.

38. An ion transport system utilizing radio frequency (RF) voltage and direct current (DC) voltage to accelerate ions along a preselected path from a distal end toward a proximal end of the ion transport system, wherein electrode pairs are created to thereby at least partially cancel undesirable quadrapolar DC fields, said ion transport system comprising:

at least four pairs of electrodes disposed generally equidistant from adjacent electrode pairs about a common axis, wherein each pair of the at least four pairs of electrodes is comprised of tapered and generally parallel electrodes, and wherein each pair of the at least four pairs of electrodes are comprised of:

a first electrode having a larger cross section at the distal end than at the proximal end;

a second electrode having a smaller cross section at the distal end than at the proximal end, wherein a nearest electrode of a nearest pair of electrodes is oppositely tapered relative to the second electrode, and wherein the first and the second electrode form an oppositely tapered electrode pair which at least partially cancels quadrapolar DC fields generated therefrom, wherein a positive RF voltage is applied to the first electrode and to the second electrode of the first pair of the at least four pairs of electrodes, and wherein a negative RF voltage is applied to the first electrode and to the second electrode of a second pair of the at least four pairs of electrodes, and wherein an oppositely charged RF voltage is applied to a next subsequently adjacent pair of electrodes of the at least four pairs of electrodes, until each of the at least four pairs of electrodes has an RF voltage applied thereto, wherein a higher DC voltage is applied to the electrode of each of the at least four pairs of electrodes relative to a lower DC voltage which is applied to the second electrode of each of the at least four pairs of electrodes, and wherein the cross section of each of the at least four pairs of electrodes is selected from the group of cross sections consisting of ellipsoids and polygons.

* * * * *